United States Patent [19]

Forbes

[11] 4,006,595

[45] Feb. 8, 1977

[54] REFRIGERANT-POWERED ENGINE

[75] Inventor: William J. Forbes, Cocoa, Fla.

[73] Assignee: Orange State, Inc., Cocoa, Fla.

[22] Filed: Dec. 30, 1975

[21] Appl. No.: 645,396

[52] U.S. Cl. ..... 60/651; 60/516; 60/571

[51] Int. Cl.[2] ..... F01K 25/10

[58] Field of Search ..... 91/4 R; 60/650, 651, 60/670, 671, 516, 721

[56] References Cited

UNITED STATES PATENTS

| | | | |
|---|---|---|---|
| 3,100,965 | 8/1963 | Blackburn | 91/4 X |
| 3,608,311 | 9/1971 | Roesel, Jr. | 60/516 |
| 3,890,784 | 6/1975 | Tubeue | 60/516 |
| 3,901,033 | 8/1975 | McAlister | 60/516 |

*Primary Examiner*—Allen M. Ostrager
*Attorney, Agent, or Firm*—Lowe, King, Price & Markva

[57] ABSTRACT

A system for powering a gas-sealed, flywheel-type turbine comprises a pair of pressurized storage tanks used alternately as a source and sink of Freon. A rotary valve, in a first position, directs liquid Freon from the first storage tank, functioning as a Freon source, to a boiler to produce super-heated Freon vapor. The super-heated vapor is used to directly drive the turbine, and the turbine exhaust vapor is converted back to liquid Freon in a condenser. The high pressure outlet of the turbine is used, via a capillary tube, to supply pressure for forcing the liquid Freon from the storage tank to the boiler. The condensed Freon is then directed, through the rotary valve, to the second storage tank functioning as a Freon sink. When the liquid Freon in the first storage tank is nearly depleted, boiling of the Freon is detected by a thermostatic bulb in thermal contact with the tank bottom. A solenoid arrangement, controlled by the thermostatic bulb, indexes the rotary valve to a second position, and the system drives the turbine with the second storage tank functioning as the Freon source and the first storage tank functioning as the Freon sink. When the second tank is nearly depleted, Freon boiling is detected by a second thermostatic bulb in thermal contact with the second tank bottom. The second bulb, via the solenoid arrangement, indexes the rotary valve back to the first position and the process repeats to provide continuous operation of the turbine.

32 Claims, 14 Drawing Figures

REFRIGERANT-POWERED ENGINE

BACKGROUND OF THE INVENTION

The present invention relates generally to a Freon-powered engine, and more particularly to a method and system for driving a sealed, flywheel-type turbine wherein a part of Freon storage tanks are used alternately as a source and sink of liquid Freon.

Perhaps the most serious problem facing this generation is the creation of air pollution as a result of the by-products of the automobile internal combustion engine. Alternatives have been sought to the internal combustion engine. Some of the alternatives have proven to be unreliable, prohibitively expensive or inefficient, and others have been found to produce additional forms of pollution, or to require expensive fuels. There still exists a need for a practical alternative to the internal combustion engine.

OBJECTIVES OF THE INVENTION

Accordingly, one object of the present invention is to provide a new and improved engine avoiding disadvantages of the internal combustion engine indicated above.

Another object of the present invention is to provide a new and improved source of motive power which does not generate by-product pollutants into the atmosphere.

Another object of the present invention is to provide a new and improved engine which is clean and efficient, yet easy to manufacture and economical to operate.

Another object of the present invention is to provide a new and improved Freon-powered engine, wherein a pair of Freon storage tanks are used alternately as a source and sink of liquid Freon.

Another object of the present invention is to provide a new and improved Freon-powered engine having a pair of Freon storage tanks used alternately as a source and sink of liquid Freon, wherein change-over occurs automatically in response to a low level of liquid Freon in the source tank.

Another object of the present invention is to provide a new and improved Freon-powered engine, wherein super-heated Freon vapor is circulated in a closed system between source and sink Freon storage tanks to directly and continuously drive a turbine.

SUMMARY OF THE INVENTION

In accordance with the invention, a system for generating motive power comprises first and second pressurized Freon storage tanks used alternately as a source and sink of liquid Freon for powering a gas-sealed, flywheel-type turbine, wherein change-over of the storage tanks is provided automatically in response to a low level of liquid Freon in the storage tank functioning as the source. The flow of Freon is controlled by a rotary valve indexable between two positions. In a first position, the rotary valve causes liquid Freon to flow from the first storage tank (functioning as a source) to a boiler. The boiler heats and vaporizes the liquid Freon to a super-heated vapor which is used to directly drive the turbine. The high pressure outlet of the turbine supplies pressure, via a capillary tube, to force the liquid Freon from the first cylinder to the boiler. The Freon vapor exhaust from the turbine outlet is converted back to liquid Freon in a condenser, and then transferred to the second storage tank (functioning as a sink).

A thermostatic bulb is attached to the bottom of each Freon storage tank. As the liquid Freon in the first storage tank nears bottom, the Freon tends to boil, refrigerating the thermostatic bulb attached to the first tank. The bulb closes a switch which in turn causes a first solenoid to be energized to index the rotary valve to a second position. In the second position, the operation of the system is similar to that described above, but with the second tank functioning as the source and the first tank functioning as the sink. As the liquid Freon nears the bottom of the second storage tank boiling of the liquid Freon refrigerates the thermostatic bulb attached to the bottom of the second tank. The second bulb causes a second solenoid to be energized which indexes the rotary valve back to its first position, and the process repeats to continuously drive the turbine.

The body of the rotary valve is formed of 8-sided stock with valve ports extending from the perimeter of the body to an inner chamber. A rotary disc is rotatably-mounted in the inner chamber, and contains a set of flow directing channels which selectively join adjacent ports of the valve body. A stem, attached to the disc, is connected to a pair of connecting arms, coupled, respectively, to the first and second solenoids.

The solenoids are mounted to a base member on opposite sides of the stem. When the first solenoid is energized, the rotary valve is indexed counterclockwise by the first connecting arm causing the first storage tank to function as a source and the second storage tank to function as a sink. When the second solenoid is energized, the rotary valve is indexed clockwise by the second connecting arm causing the second storage tank to function as a source and the first storage tank to function as a sink. In one embodiment, the solenoids freely pivot on the base during valve indexing to prevent excessive bending moments from being applied to the solenoid armatures. In another embodiment, the valve is indexed by a common armature controlled by the solenoids. The valve stem is loosely coupled to the armature to avoid any excessive bending moments.

The capillary tube connected to the high pressure outlet of the turbine is coupled to the outlet of the rotary valve whereby pressure for forcing liquid Freon to the boiler in both the valve positions is provided. As an alternative, pump means, actuated in response to valve indexing, can be incorporated in the outlet lines of the storage tanks to provide the required pressure.

A bypass valve is located between the rotary valve and the turbine to cause a controlled portion of super-heated vapor to bypass the turbine to the condenser thereby providing throttling. The super-heated Freon vapor bypassing the turbine, combined in a T-fitting with the vapor driving the turbine, is condensed back into liquid Freon and directed through the rotary valve to the sink tank.

The gas-sealed, flywheel-type turbine comprises a casing containing an inlet and outlet and enclosing a massive flywheel rotor rotatably mounted to a set of bearings. The rim of the rotor contains a series of half-moon ground indentations angularly offset with respect to the radii of the rotor to receive the Freon vapor supplied to the turbine at the inlet. The vapor is directed around the rim of the rotor and through the casing outlet during rotation. The rotor is brought up to operating speed using a convention Bendix starter, and Freon vapor pressure impinging in the rim of the rotor at the indentations sustains rotation under load.

I am aware of another Freon-powered engine, described in U.S. Pat. No. 3,531,933 to Baldwin. Therein, a closed circuit power unit using Freon as a prime mover powers a three-cylinder double-acting piston-type reciprocating engine. Super-heated Freon vapor powers the engine and is then condensed and returned for reuse in its liquid state to a single source of liquid Freon. Since a single Freon source is used, liquid Freon condensed from the super-heated vapor exhausted from the engine may be cooled extremely rapidly requiring a complex vapor condensing system.

In U.S. Pat. No. 3,648,456 to McAlister, water vapor is alternatively directed into one of two reservoir tanks to force water in each tank out of the tank by pressure of the vapor and through a fluidic motor to refill the other tank. Vapor pressure remaining in the tank being refilled is vented to the atmosphere, and water, not super-heated vapor, is used to drive the fluid engine.

Still other objects and advantages of the present invention will become readily apparent to those skilled in this art from the following detailed description, wherein I have shown and described only the preferred embodiments of the invention, simply by way of illustration of the best modes contemplated by me of carrying out my invention. As will be realized, the invention is capable of other and different embodiments, and its several details are capable of modifications in various obvious respects, all without departing from the invention. Accordingly, the drawings and description are to be regarded as illustrative in nature, and not as restrictive.

DETAILED DESCRIPTION OF THE DRAWING

DETAILED DESCRIPTION OF THE PREFERRED EMBODIMENTS

Figure 1:
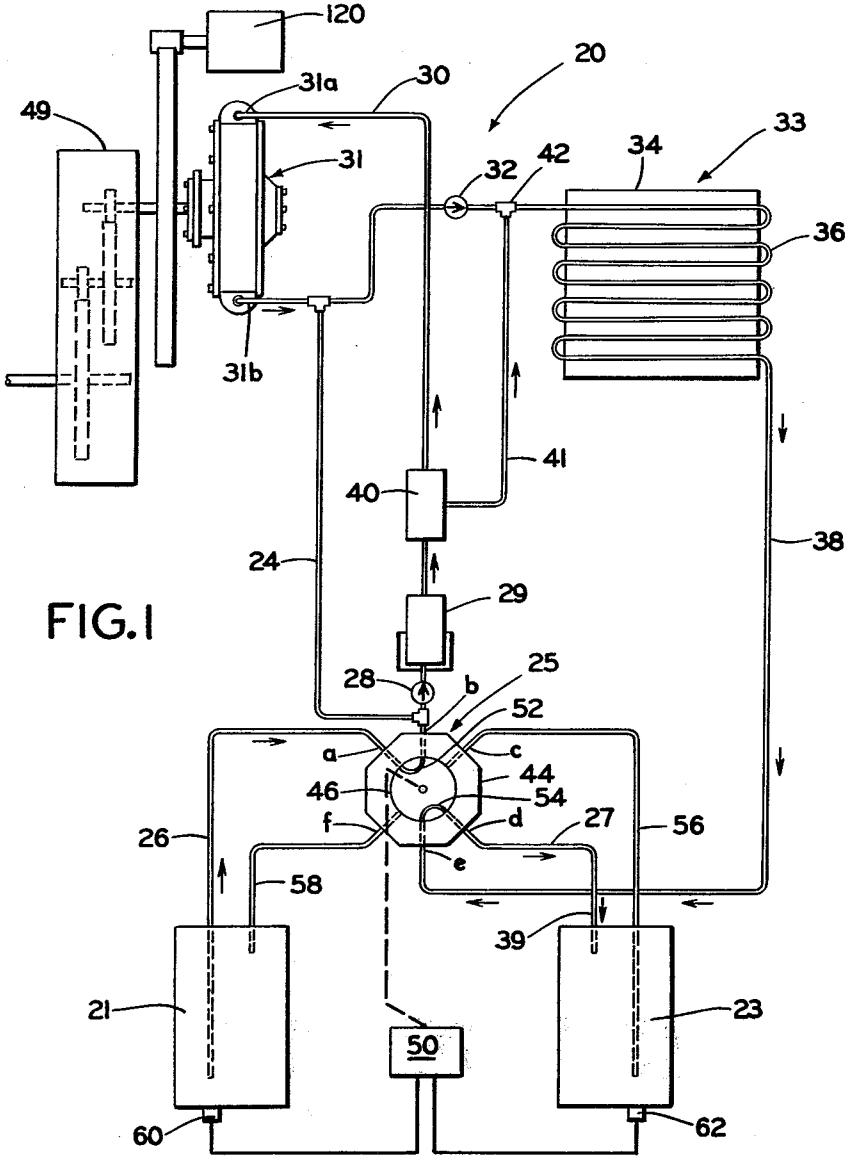
FIG. 1 is a schematic diagram of a preferred embodiment of the system, in accordance with the invention, with a first version of a rotary valve indexed counterclockwise, the first storage tank functioning as a source and the second storage tank functioning as a sink.

Referring to FIG. 1, system 20, in accordance with one embodiment of the present invention, basically comprises first and second pressurized liquid refrigerant storage tanks 21 and 23, rotary valve 25, valve actuator 50, boiler 29, turbine 31 and condenser 33. As will be discussed in detail below, refrigerant such as liquid Freon stored in one of the storage tanks 21 and 23 is transferred to boiler 29 where the Freon is heated forming a super-heated vapor. The super-heated vapor directly drives turbine 31 and the turbine exhaust is condensed back to liquid Freon in condenser 33, and then directed to the other liquid storage tank functioning as a sink. Rotary valve 25 causes the storage tanks 21 and 23 to alternately function as sources and sinks of Freon. "Freon 11" is used as the refrigerant in the preferred embodiment, and additives such as lubricating oil may be mixed therein. However, it is to be understood that other suitable refrigerants could be used depending on particular load requirements.

Still referring to FIG. 1, one preferred embodiment of rotary valve 25, which will be discussed in more detail below in conjunction with FIGS. 3–6, comprises a valve body 44, formed of eight-sided stock, containing a rotary disc 46. Although valve body 44 is formed of eight-sided stock due to the availability of the stock and the convenience of milling the ports on the flats formed on the outer surface, it is to be understood that any other suitable valve body configuration can be used. A stem 48 (FIG. 5), attached to the disc 46, is indexed (rotated) by an actuator 50.

Valve body 44 contains six ports labeled respectively *a–f* formed in six of the flats formed in the eight-sided stock. Rotary disc 48 mounted within body 44 contains two U-shaped channels 52 and 54. U-shaped channel 52 is formed so as to join together either ports *a* and *b* of valve body 44 or ports *b* and *c*. Similarly, channel 54 is formed so as to join together either ports *d* and 3 of the body 44 or ports *e* and *f*. In FIG. 1, rotary disc 46 is indexed counterclockwise so that ports *a* and *b* are joined together as well as ports *d* and *e*, while in FIG. 2, the disc is indexed clockwise to join together ports *b* and *c* as well as ports *e* and *f*.

Figure 2:
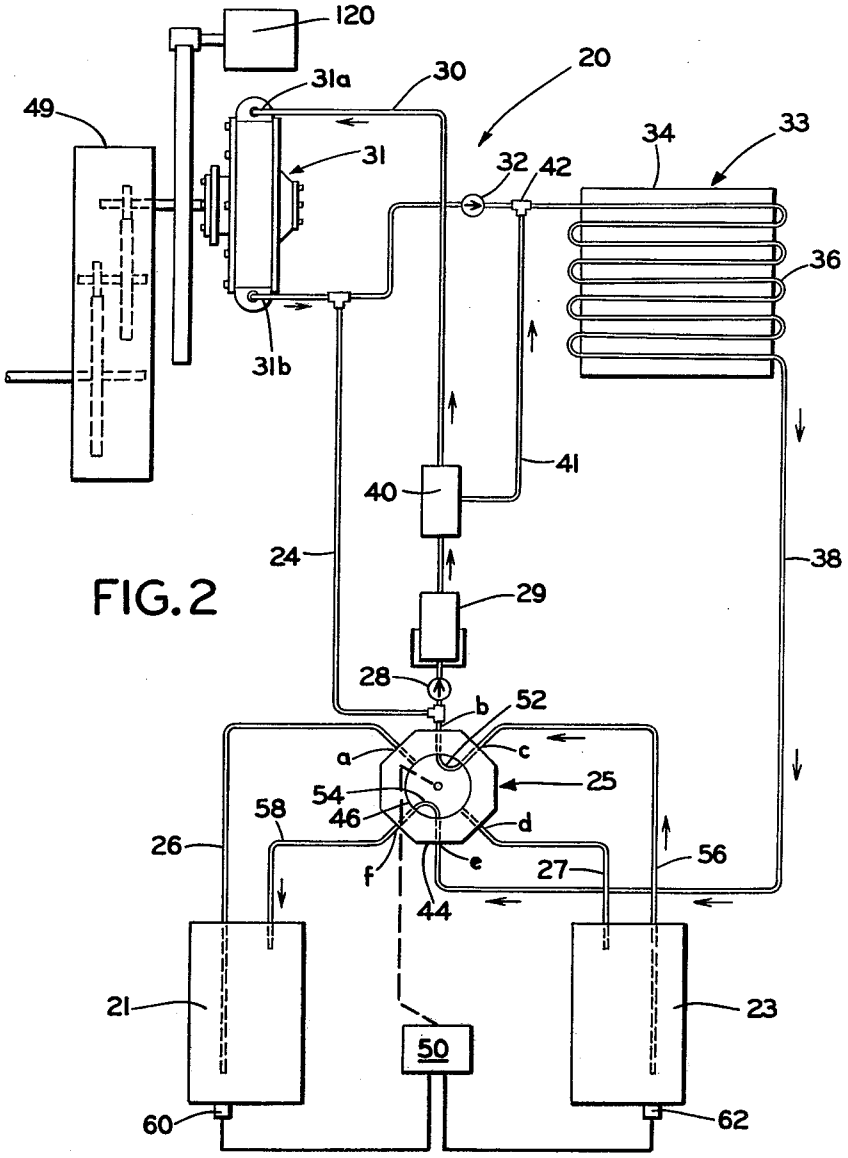
FIG. 2 is a schematic diagram, similar to FIG. 1, with a rotary valve indexed clockwise, the first storage tank functioning as a sink and the second storage tank functioning as a source.

Referring now to FIGS. 1 and 2, system 20 is shown respectively (1) with rotary valve 25 indexed counterclockwise whereby tank 21 functions as a Freon source and tank 23 functions as a Freon sink, and (2) with the valve indexed clockwise whereby the roles of the two tanks are reversed. With attention directed first to FIG. 1, a capillary line 24 is coupled between the high pressure outlet 31*b* of turbine 31 and outlet *b* of rotary valve 25 to created pressure sufficient to force liquid Freon from tank 21, through ports *a* and *b* of the rotary valve, and to boiler 29 via a conventional one-way check valve 28.

Liquid Freon is heated in boiler 29 to a temperature sufficient to convert the Freon to a super-heated vapor. The pressure of expanding super-heated vapor causes the vapor to flow to inlet 31*a* of turbine 31 through line 30 for driving the flywheel (not shown) of the turbine. The turbine exhaust from high pressure outlet 31*b*, i.e., super-heated Freon vapor that has passed through and driven turbine 31, flows to condenser 33 via a conventional one-way check valve 32.

Condenser 33 comprises an insulated tank 34 which contains a coolant such as ethylene glycol. Immersed in the tank of ethylene glycol is coil 36 which causes the super-heated Freon vapor to transfer sufficient heat to the ethylene glycol to return the Freon vapor to the liquid state. Liquid Freon from condenser 33 is then directed to Freon storage tank 23 through line 38 and ports *d* and *e* of rotary valve 25.

A bypass valve 40, located in line 30 between turbine 31 and boiler 29 causes a portion of the super-heated Freon vapor to bypass the turbine and the check valve 32 to condenser 33 at T-fitting 42. One embodiment of a bypass valve for bypassing turbine 31 with a controlled portion of the super-heated Freon gas is disclosed in Baldwin U.S. Pat. No. 3,531,933, discussed supra.

Referring to FIG. 2, the operation of system 20 with valve disc 46 of rotary valve 25 indexed clockwise is identical to operation shown in FIG. 1, except that the rotary valve now causes the storage tank 21 to function as a Freon sink and storage tank 23 to function as a Freon source. More specifically, in FIG. 2, liquid Freon is drawn from tank 23 to valve 25 through line 56 by suction produced by capillary 24. The liquid Freon is caused to flow through U-shaped channel 52 in rotary disc 46 via ports *b* and *c* of valve body 44, and through one-way check valve 28, into boiler 29. As described with respect to FIG. 1, boiler 29 heats the liquid Freon sufficiently to convert the liquid Freon to a super-heated Freon vapor which, through bypass valve 40, is directed to turbine 31. The flywheel of turbine 31 is rotated by the super-heated Freon vapor thereby converting energy stored in the vapor to motive power. Exhaust from turbine 31 at exhaust port 31*b* is passed through one-way check valve 32 and combined in T-member 42 with the Freon vapor bypassed by the bypass valve 40. The combined vapor is condensed to liquid Freon in condenser 33, and directed to storage tank 21 (now functioning as a sink) through U-channel 54 and ports *e* and *f* of valve 25.

A pair of thermostatic bulbs 60 and 62 (FIGS. 3 and 6) are attached to the bottom of tanks 21 and 23, respectively, and are in thermal contact therewith. The bulbs 60 and 62 detect deplection of liquid Freon in each tank, and generate an output which serves to index rotary valve 25 to change the respective roles of the two tanks, that is, to cause the tank functioning as a sink to function as a source, and the tank functioning as a source to function as a sink. The operation of actuator 50 in conjunction with thermostatic bulbs 60 and 62 is described in detail below. However, as the level of liquid Freon in each tank approaches the tank bottom, i.e., below outlet lines 26 and 56, respectively, the liquid Freon (maintained in the liquid state due to the pressurization of the tank) tends to boil due to decreased pressure on the surface of the liquid Freon. The boiling of the Freon refrigerates the bottom of the tank along with the thermostatic bulb 60 or 62 in thermal contact therewith. The output of the thermostatic bulb is coupled to actuator 50, which, in response to bulb 60 or 62, indexes rotary disc 46 of valve 25 via stem 48.

More specifically, referring to FIG. 1, when the level of liquid Freon in tank 21, functioning as a source, nears the bottom of the tank, boiling of the liquid Freon refrigeratates thermostatic bulb 60. Actuator 50 in response to refrigeration of bulb 60, causes a solenoid, contained in the actuator and described in detail below, to index valve 25 clockwise to the position shown in FIG. 2 wherein tank 23 functions as a source and tank 21 functions as a sink. As the level of liquid Freon in tank 23 approaches the bottom of the tank, Freon boiling refrigerates thermostatic bulb 62. In response thereto, actuator 50 causes another solenoid, contained in the actuator, to be energized thereby to index rotary valve 25 counterclockwise back to the position shown in FIG. 1, and the process repeats. The result is that super-heated Freon vapor is supplied continuously to drive turbine 31.

Figure 3:
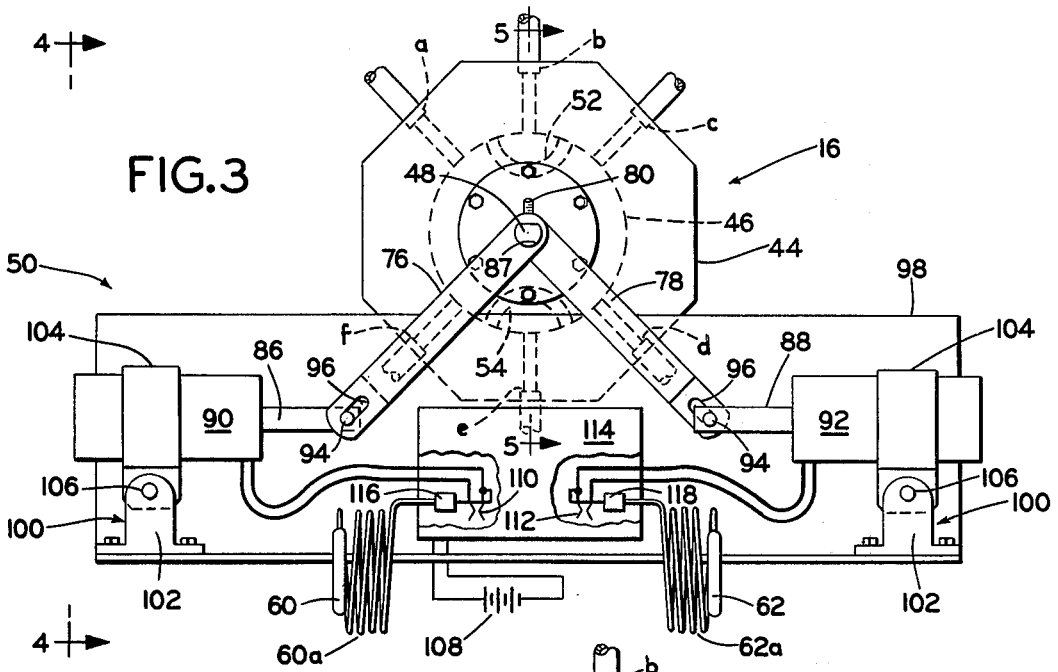
FIG. 3 is a detailed description of the rotary valve shown in FIGS. 1 and 2, and an actuating means therefor.

Referring to FIG. 3, rotary valve 25 and actuator 50, used in the embodiment of FIGS. 1 and 2, will now be described in detail. Rotary valve 25 comprises a valve body 44 which, as aforementioned, is formed of eight-sided stock with ports *a–f* formed respectively in six flat faces of the stock (two of the faces do not contain a port as seen in FIG. 3). Rotary disc 46 is rotatably mounted within the body 44 and contains U-shaped channels 52 and 54. The channels 52 and 54 join together ports *a* and *b* along with ports *d* and *e* when the disc 46 is indexed counterclockwise (FIGS. 1 and 6), and join together ports *b* and *c* along with ports *e* and *f* when indexed clockwise (FIG. 2). In FIG. 3, rotary disc 46 is shown as being located in a neutral position with the U-shaped channels 52 and 54 out of alignment with the ports *a–f* in the valve body 44. However, it is to be understood that during operation of system 20, disc 46 is indexed either clockwise or counterclockwise.

Figure 5:
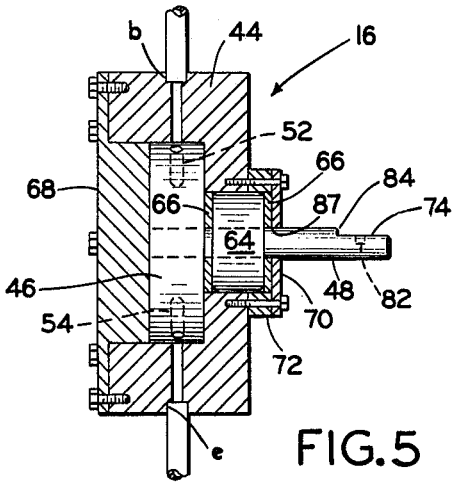
FIG. 5 is a vertical section of the valve viewed along the line 5—5 in FIG. 3.

Rotary disc 46 is attached to stem 48 which extends out of valve 25 through a bearing 64 (see FIG. 5). Seals 55 are located on each end of bearing 64 to prevent any leakage of Freon from the rotary disc 46. The disc 46 is contained within the valve body 40 by a closure member 68 bolted to the rear of the valve body. An end cap 70 having an aperture 86 for shaft 48 is bolted to valve body 44 through a ring member 72.

It should be mentioned that the entire system 20 is tightly sealed to prevent any leakage of Freon either in the liquid or super-heated vapor state from leaking into the atmosphere to prevent having to frequently recharge the system with Freon and to prevent polluting the air and ionosphere. Particularly, it is necessary that flywheel turbine 31 be completely vapor sealed to prevent any leakage of super-heated Freon vapor therefrom during operation. A gas-sealed, flywheel-type turbine suitable for this purpose is described in detail infra.

Referring again to FIG. 5, one end of shaft 48 contains a notch 74 for fitting into hemispherically-shaped apertures 87 in connecting arms 76 and 78 (FIG. 3). The connecting arms 76 and 78 are preferably secured to shaft 48 at the notch 74 with a set screw 80. Set screw 80 screws down into a threaded bore 82 to maintain connecting arms 76 and 78 sandwiched between the set screw and shoulder 84 of the notch 74.

Apertures 87 formed in connecting arms 76 and 78 are oriented, relative to the arms, such that the arms mount to shaft 48 at approximately a right angle with respect to each other as shown in FIG. 3. Connected to the opposite ends of arms 76 and 78 are armatures 86 and 88 respectively of solenoids 90 and 92. The armatures 86 and 88 are fastened to the arms 76 and 78 with pins 94 extending through elongated slots 96. The elongated shape of slots 96 permit some play between armatures 86 and 88 and arms 76 and 78, respectively.

Solenoids 90 and 92 of actuator 50 are mounted to base 98 with pivot mounts 100. Pivot mounts 100 comprise, as more clearly seen in FIG. 4, bracket 102 bolted to base 98, with a ring clamp 104 extending around the body of solenoids 90 and 92 and supported between the shoulders 102*a*, 102*b* of bracket 102 with a nut and bolt 106. The nut and bolt are not tightened against the shoulders of bracket 102 so that ring clamp 104 sandwiched between shoulder 102*a*, 102*b* is free to pivot. Pivoting of solenoids 90 and 92 in bracket 102 prevents excessive bending moments from being applied to armatures 86 and 88 during indexing of rotary valves 16, and this avoids excessive wearing of the solenoid bearings and fracturing of the armatures.

Solenoids 90 and 92 of actuator 50 are energized by a DC power source 108, preferably a battery charged by a generator (not shown) belt-driven by turbine 31. Of course, it is not necessary that solenoids 90 and 92 be DC powered solenoids; the solenoids could be of the AC powered type with battery 108 being replaced by an AC power source, such as an alternator.

Solenoids 90 and 92 of actuator 50, which, in the preferred embodiment, are of conventional type wherein the armature 86 or 88 is drawn into the body of the solenoid in response to current flowing through the solenoid field coil, are caused to be energized respectively by switches 110 and 112, shown schematically in FIG. 3. The switches 110 and 112 are contained in a conventional dual temperature thermostatic switching unit 114, and are connected in series with respective solenoids 90 and 92 and DC power source 108. Switches 110 and 112 are each normally open switches which, when closed, cause its corresponding solenoid to be energized.

Switches 110 and 112 are in turn controlled respectively by bellows 116 and 118 which are responsive to thermostatic bulbs 60 and 62. Although bulbs 60 and 62 are shown as being located adjacent actuator 60 in FIGS. 3 and 6 with capillary tube 60*a* and 62*a* coiled, in operation, the bulbs are located in thermal contact with the bottom of tanks 21 and 23 (FIGS. 1 and 2). Dual temperature thermostat 114 is preset, by conventional means, such that switches 110 and 112 close when the temperature of bulbs 60 and 62 are respectively lowered to the boiling temperature of Freon 11.

Figure 6:
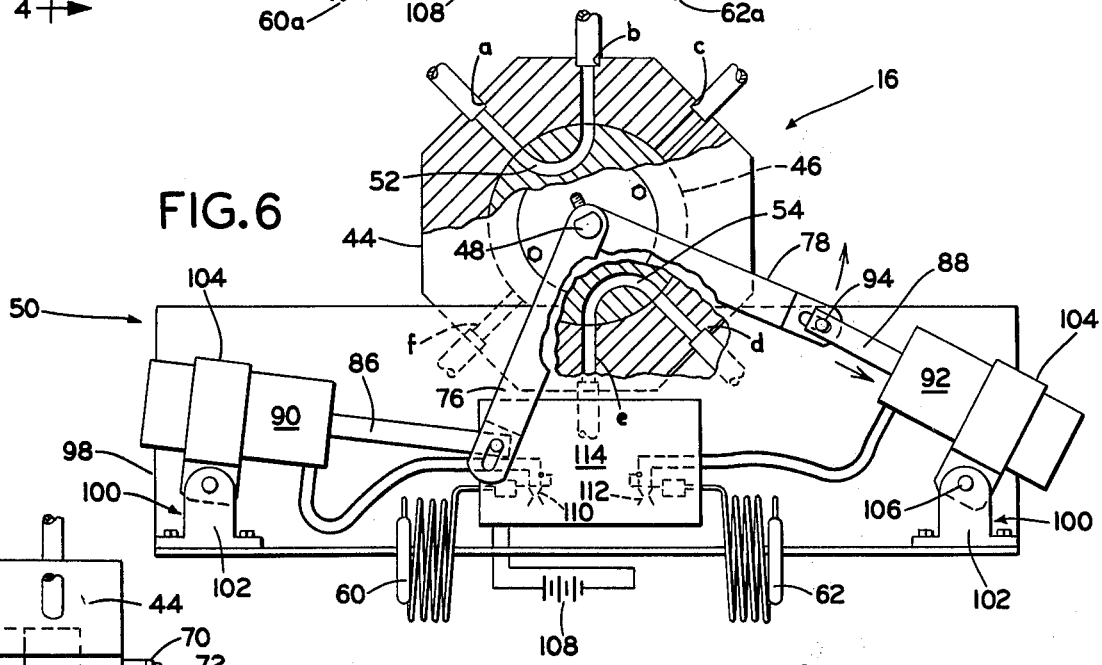
FIG. 6 is a detailed illustration of the rotary valve and actuating means, with the valve indexed counterclockwise.
Figure 4:
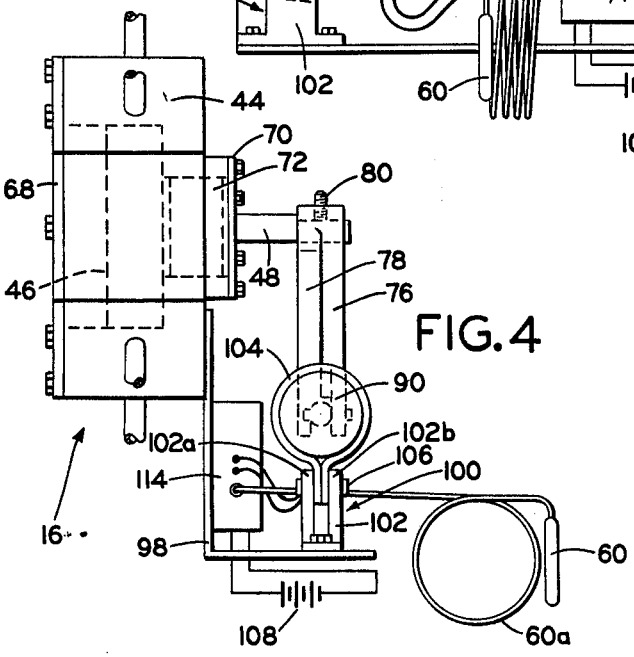
FIG. 4 is an end view of the valve and actuating means viewed along the lines 4—4 of FIG. 3.

When switch 110 or 112 is closed, its corresponding solenoid is energized to draw in the solenoid armature thereby pulling the connecting arm 76 or 78 to which it is attached. For example, when thermostatic bulb 62 is cooled by the boiling of liquid Freon at the bottom of tank 23, bellows 118 contracts closing switch 112 and energizing solenoid 92. As shown in FIG. 6, armature 88 of solenoid 92 is drawn into the body of the solenoid causing valve disc 46 of the rotary valve 25 to index counterclockwise to the position shown. Meanwhile, solenoids 90 and 92 freely pivot on pivot mounts 100 to avoid excessive bending movements from being applied to armatures 86 and 88. On the other hand, when thermostatic bulb 60 is cooled by the boiling of liquid Freon at the bottom of storage tank 21, bellows 116 contracts causing switch 110 thereby to energize solenoid 90. Armature 86 of solenoid 90 is drawn into the solenoid causing valve 46 of the rotary valve 25 to index clockwise as shown schematically in FIG. 1. Since solenoid 92 is not energized, armature 88 is free to follow the disc 46 via connecting arm 78, and, as aforementioned, the solenoid freely pivots on pivot arm 100.

Each of solenoids 90 and 92 remains energized so long as switch 110 and 112, respectively, is closed. Each switch 110, 112, in turn, is closed so long as thermostatic bulb 60 and 62 is maintained below the predetermined temperature for actuation. To minimize power consumption, a conventional one-shot circuit (not shown) may be connected between the switches 110, 112 and corresponding solenoids 90, 92 to energize the solenoids for only a time duration sufficient to ensure indexing of the rotary valve 25 in response to switch closure.

Although solenoids 90 and 92 are illustrated as being of the type having armatures which retract into the solenoid during energization, alternatively, solenoids of the opposite type wherein the armatures are extended outwardly from the solenoid during energization could be used. These solenoids (not shown) are located in the central region of base 98 between the lower ends of connecting arms 76 or 78, with the solenoids being angled upwardly toward the connecting arms. The solenoid armatures are linked to the elongated slots 96 and the connecting arms 76 and 78 to index the rotary valve 25 directly as the solenoids are energized.

Turbine 31 (FIGS. 1 and 2) drives gear train 49 to provide motive power for any application, and particularly for powering an automobile. Obviously, the inventive system could be used to drive any other suitable load, such as a compressor for cooling a home, or a generator for producing electricity. In practice, the flywheel of turbine 31 is brought up to 6–10,000 RPM by a conventional Bendex-type starter unit 120, and rotation of the flywheel is sustained under load by the super-heated Freon vapor generated by system 20. I have found that a 150 pound vapor pressure is sufficient to sustain rotation of a 125–135 pound turbine flywheel.

Summarizing the operation of system 20, and referring first to FIG. 1, turbine 31 is first caused to rotate by Bendix unit 120, and boiler 29 is energized and brought to a temperature sufficient to produce the super-heated Freon vapor from liquid Freon. Assuming tank 21 functions initially as the source tank, rotary valve 25 is initially idexed counterclockwise by means of a starter mechanism (not shown) which momentarily energizes solenoid 92. After the turbine 31 has been brought up to speed by Bendix 120, pressure created at exhaust port 31*b*, via capillary tube 24, causes liquid Freon to flow out of tank 21 at outlet line 26, through the rotary valve 25 and one-way check valve 28, and to the boiler 29. Super-heated Freon vapor, produced in boiler 29, expands through bypass valve 40 and line 30 to turbine 31, driving the turbine. Exhaust vapor from outlet 31*b* of turbine 31 flows through one-way check valve 32 toward condenser 33 through T-member 42. A controlled portion of the super-heated vapor, bypassing turbine 31 via valve 40 and 41 is combined with the turbine exhaust in T-member 42, and the combined vapor is supplied to condenser 22 to be condensed back into liquid Freon. The liquid Freon is then directed through ports *d* and *e* of valve 25 to tank 23, functioning as a sink. Bypass valve 40 is adjusted to cause turbine 31 to operate at the desired speed.

As the level of liquid Freon in storage tank 21 nears the bottom of the tank, the liquid Freon tends to boil refrigerating thermostatic bulb 60 which closes switch 110 in actuator 50 (see FIG. 6) and solenoid 90 indexes disc 46 in rotary valve 16 clockwise to the position shown in FIG. 2. Pressure from outlet 31*a* of the turbine 31, supplied to port *b* of the valve body 44 of rotary valve 25, draws liquid Freon up through line 56 from the tank 23, now functioning as a source of Freon. Liquid Freon in tank 23 flows along a path through rotary valve 25 in a manner similar to that described with respect to FIG. 1, but with the tank 23 functioning as a Freon source and tank 21 functioning as a Freon sink. Each time the level of liquid Freon in the particular tank functioning as a source reaches a low level, refrigeration of the thermostatic bulb in thermal contact with the bottom of that tank indexes rotary valve 25 and reverses the roles of the respective storage tanks. The operation of turbine 31 is continuous, even during storage tank change-over, and change-over occurs without any operator intervention. Thus, once the system has been initiated by bringing boiler 29 up to operating temperature, bringing turbine 31 up to speed and initially indexing rotary valve 25, operation of the turbine is sustained.

Figure 8:
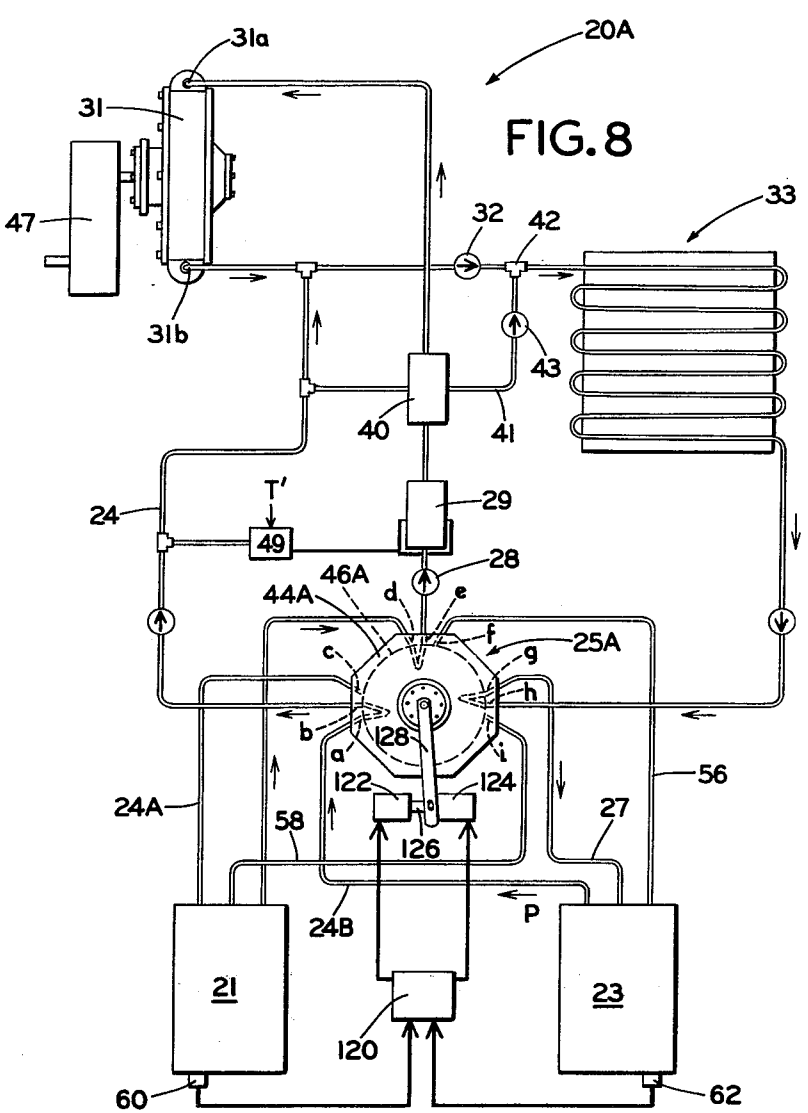
FIG. 8 is a schematic diagram, similar to FIG. 7, with the rotary valve indexed for operation as in FIG. 2.
Figure 7:
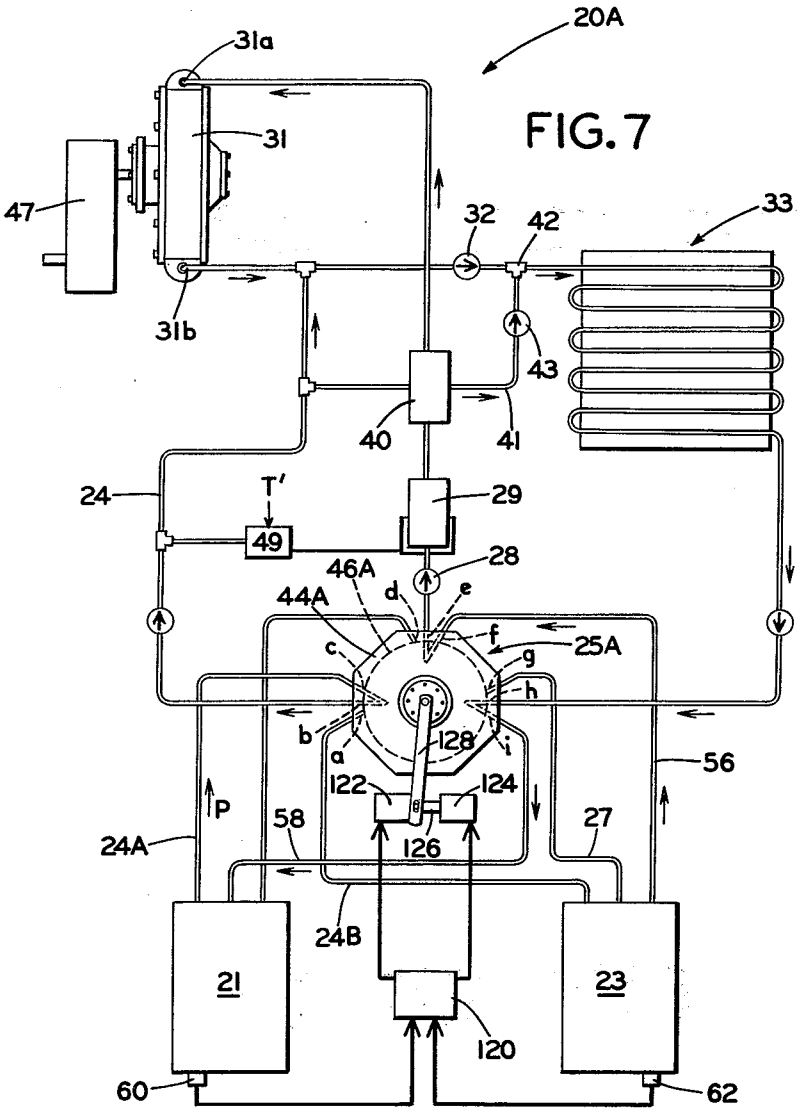
FIG. 7 is a schematic diagram of another preferred embodiment of the invention system, with a second version of the rotary valve indexed for operation as in FIG. 1.

Referring now to FIGS. 7 and 8, another preferred embodiment of the invention is described. System 20A is similar to system 20, described supra, except that a modified rotary valve 25A is used in place of valve 25. A simplified solenoid arrangement comprising solenoids 122 and 124 controls rotation of the modified rotary valve. In addition, negative "Pitot" pressure created at outlet 31A of turbine 31 is applied selectively to storage tanks 21 and 23 through an additional set of valve ports, rather than through a common port *b*, as in system 20. The negative pressure causes the tank to which the pressure is applied to draw liquid Freon and thereby function as a Freon sink.

Figure 9:
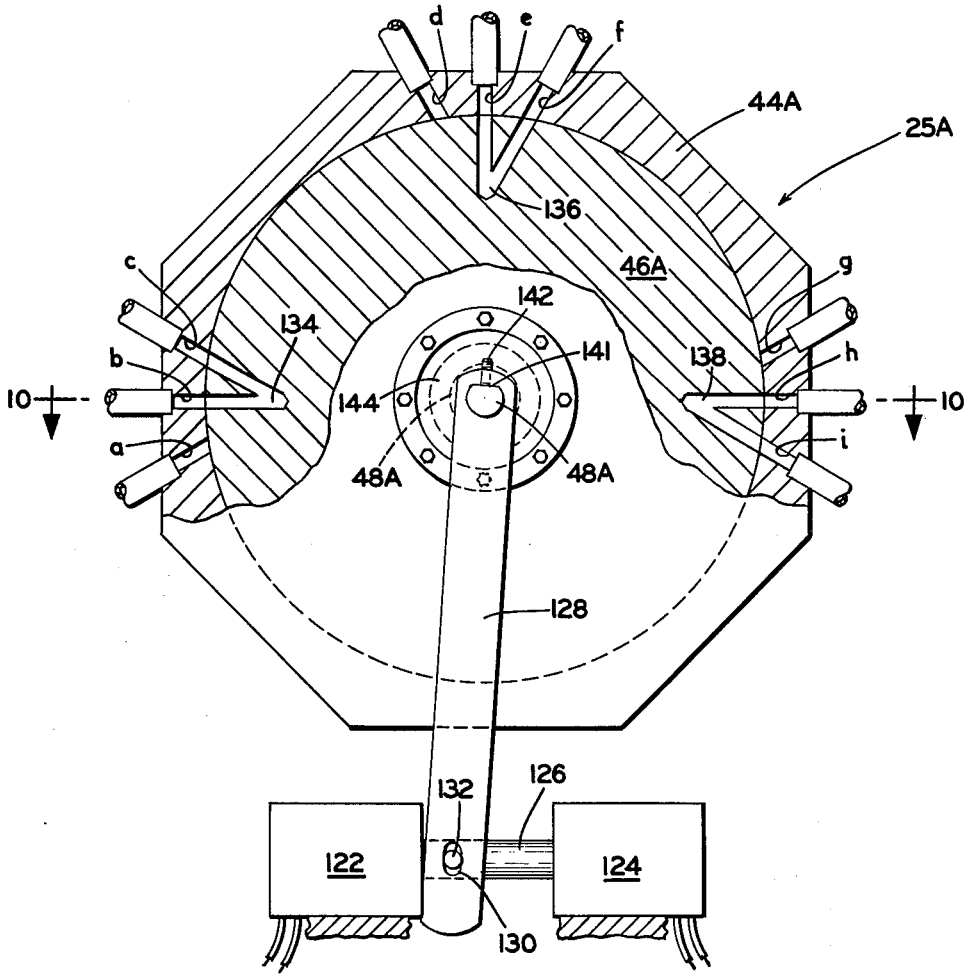
FIG. 9 is a front view of the rotary valve shown in FIGS. 7 and 8 with a portion thereof cut away to expose the valve ports.
Figure 10:
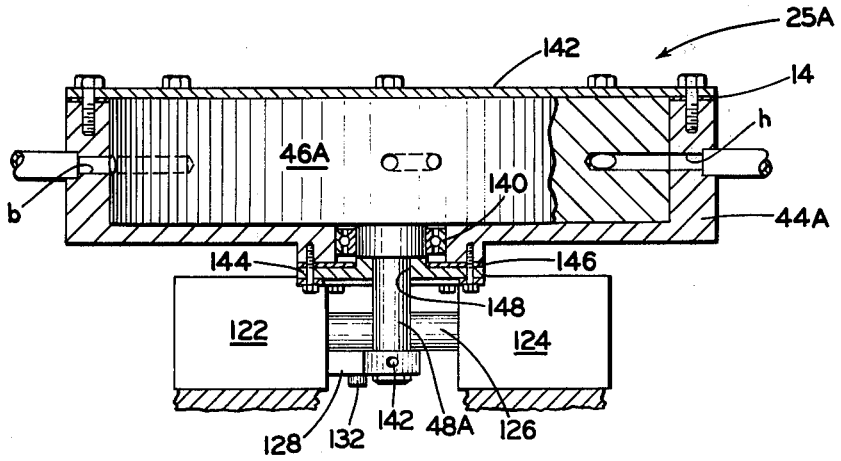
FIG. 10 is a sectional view of the rotary valve viewed along lines 10—10 in FIG. 9.

Referring to FIGS. 9 and 10, rotary valve 25A is shown in detail. The valve 25A comprises a valve housing 44A rotatably supporting a valve disc 46A. Housing 44A contains nine ports *a–i* forming inlets and outlets for liquid Freon, similar to ports *a–f* in housing 44 of rotary valve 25. Valve disc 46A contains channels 135, 136 and 138 for selectively joining together pairs of valve ports *a–i*. Particularly, when rotary valve 25A is indexed clockwise, as in FIGS. 7 and 9, channel 134 joins together ports *b* and *c*, channel 136 joins together ports *e* and *f*, and channel 138 joins together ports *h* and *i*. On the other hand, when rotary valve 25A is indexed counterclockwise, as in FIG. 8, channel 134 connects together points *a* and *b*, channel 135 joins together points *d* and *e*, and channel 138 joins together points *g* and *h*.

Valve disc 46A is mounted within housing 44A and enclosed by a backing plate 142. A gasket 144 is provided between housing 44A and plate 142 in order to seal rotary valve 25A against leakage of liquid Freon. Likewise, plate 144 is attached to housing 44A at the side of the housing opposite plate 142 with a gasket 146. The plate 144 and gasket 146 contain apertures 148 to accommodate stem 48A.

Valve disc 46A is free to rotate within housing 44A on a set of roller bearings 140. Stem 48A, attached to disc 46A extends to the outside of housing 44A and is attached to a control arm 128 at a truncated end portion 141 of the stem. A set screw 142 (FIG. 9) at one end of the control arm 128 extends therethrough to contact stem 48A thereby securing the control arm in place. The other end of the control arm 128 is loosely coupled to an armature 126 which is commonly controlled by solenoids 122 and 124. Referring to FIG. 9, the control arm 128 contains an elongated slot 30 which is mated with a projection 132 formed on armature 126 to form a loose coupling between the control arm and armature. This loose coupling prevents any stresses from being applied to the arm 128 or armature 126 during indexing.

Solenoids 122 and 124 are controlled by switching unit 120 (FIGS. 7 and 8) in turn controlled by thermostats 60 and 62. Switching unit 120 is similar to the switching unit 114 in FIG. 6 and is therefore not described in detail. In operation, when solenoid 122 is energized by switching unit 120, armature 126 is drawn into solenoid 122 causing valve 25A to be indexed clockwise to the position shown in FIG. 9. On the other hand, when solenoid 124 is energized by switching unit 120, armature 126 is drawn into solenoid 124 causing rotary valve 25A to be indexed counterclockwise. Although not shown, conventional one-shot circuitry can be provided to supply energizing current to solenoids 122 and 124 for a predetermined, limited duration upon activation by switching unit 120, in order to minimize energy consumption.

Referring to FIG. 7, with rotary valve 25A indexed counterclockwise, as shown, and storage tanks 23 and 21 functioning respectively as a source and sink of Freon, the discharge outlet 31B of turbine 31 produces a negative pressure in tank 21 by way of line 24 and ports *b* and *c* of valve 25A. The negative pressure in tank 21 causes liquid Freon from tank 23 to be drawn through ports *f* and *e* of valve 25A and check valve 28 to boiler 29. The liquid Freon is heated to super-heated Freon vapor in boiler 29 and the vapor is passed through thottle 40 to inlet 31A of turbine 31. The vapor passes throught the turbine 31 sustaining rotation of turbine rotor (not shown), and the vapor is directed from discharge outlet 31B, through check valve 32, to condenser 33. A portion of the superheated vapor, determined by the setting of throttle 40, bypasses turbine 31 via line 41 and check valve 43. Vapor from the discharge outlet 31B of turbine 31 and vapor from line 41 are combined in T-fitting 42 at the input of condenser 33. The combined vapors are condensed back to liquid Freon in condenser 33 and directed to storage tank 21 through ports *h* and *i* of valve 25A.

When tank 23 is nearly depleted of liquid Freon, Freon boiling is detected by thermostat 62. Thermostat 62 controls switching unit 120 to energize solenoid 124. Solenoid 124, when energized, draws armature 126 to the right, as shown in FIG. 8, and thereby indexes rotary valve 25A counterclockwise. A negative pressure in thus created in storage tank 23 by the discharge outlet 31B of turbine 31 through line 24B and ports *b* and *a* of valve 25A. Thus, in FIG. 8, system 20A functions similarly to that in FIG. 7, but with tank 21 functioning as the Freon source and tank 23 functioning as a sink.

The amount of energy supplied to the Freon vapor at boiler 29 is controlled by the temperature of the boiler controlled by a conventional boiler control unit 49, set arbitrarily at temperature $T_1$. The temperture of the boiler is also controlled by the output of turbine 31 so as to maintain a turbine rotor speed that is invariant with respect to loading via gear box 49. Also, although now shown, oil precipitated from the liquid Freon during vaporization in boiler 29 may be directed to gear box 49 for lubrication.

Figure 12:
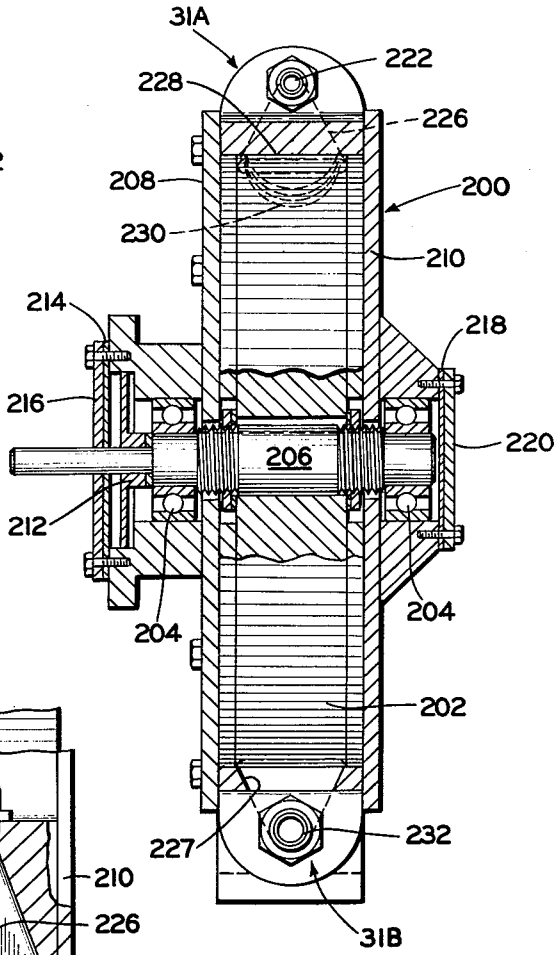
FIG. 12 is a sectional view of the turbine viewed along the line 12—12 in FIG. 11.
Figure 13:
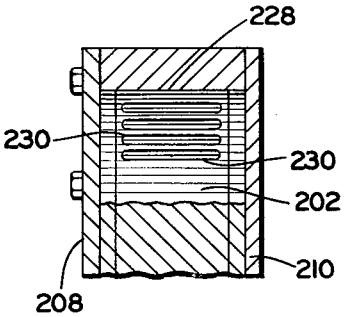
FIG. 13 is a detailed view of a portion of the periphery of the flywheel rotor viewed along the line 13—13 in FIG. 11.
Figure 14:
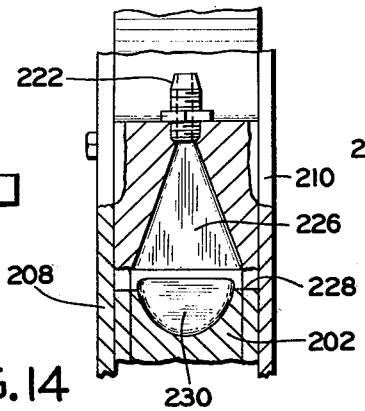
FIG. 14 is a detailed view of a rotor indentation viewed along the line 14—14 in FIG. 11.

With reference now to FIGS. 11–14, turbine 31 will be described in detail. Turbine 31 comprises a casing 200 having an inlet 31A and an outlet 31B formed in the casing surface. A disc-shaped massive rotor 202 having a shaft 206 rotatably mounted within the casing on a set of bearings 204 (FIG. 12). The casing 200 comprises, on each side turbine 31, body face plates 208 and 210 respectively. Body face plate 208 is sealed to casing 200 with a seal 212 enclosed by gasket 214 and an outer face plate 216. Body face plate 210 is sealed to casing 200 with a gasket 218 and another outer face plate 220.

Inlet 31A contains a nozzle 222 attached to a support member 224. A channel 226 extends between nozzle 222 and rim 228 of rotor 202 (see FIG. 14). Channel 226 diverges to a width slightly less than the width of rotor 202. Similary, outlet 31B contains a nozzle 232 attached to support member 225, and a diverging channel 227 extending between the nozzle and rim 228 of the rotor 202.

Figure 11:
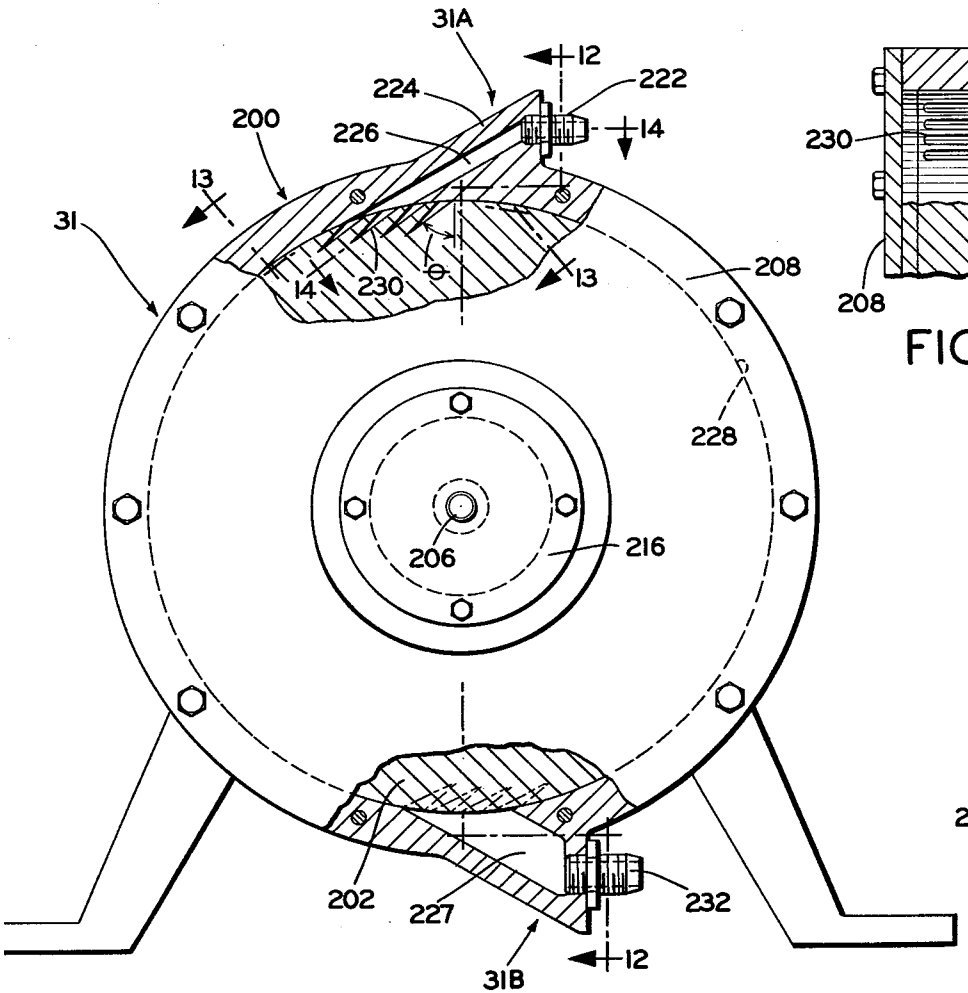
FIG. 11 is a side view of a preferred embodiment of a gas-sealed, flywheel-type turbine in accordance with the invention.

The rim 228 of rotor 202 contains a series of indentations 230 angled away from the radii of the rotor at an angle in the direction of inlet channel 226 (FIG. 11). The indentations 230 serve to collect super-heated Freon vapor impinging on rim 228 of rotor 202 supplied to inlet 31A. The force of the Freon vapor against the indentations 230 sustains rotation of the rotor as the vapor is directed around the interior of the turbine between the rotor and inner surface of casing 200, and discharged through outlet 31B at nozzle 232. Indentations 230 are half-moon ground (see FIGS. 13 and 14). Although the particular configuration of indentations 230 would depend upon particular loading requirements, I provide the indentations at an angle $\theta$ of 20°. The indentations are three inches wide at the rim of the rotor, measure ¼ inch along the circumference of rim 228, and extend ½ inch into the rotor. I have found that this configuration and angle $\theta$ of rotor 202 provides sufficient torque to sustain rotation in a 125 pound rotor using approximately 150 pounds of vapor pressure.

As discussed supra, rotor 202 must be first brought up to operating speed with a conventional Bendix starter system. Thereafter, torque produced by Freon vapor impinging on indentations 230, and the "flywheel effect" of the massive rotor 202 sustains rotation. Since turbine 31 is completely gas-sealed, there is no leakage of Freon vapor into the atmosphere.

In this disclosure, there is shown and described only the preferred embodiments of the invention, but, as afore-mentioned, it is to be understood that the invention is capable of use in various other combinations and environments and is capable of changes or modifications within the scope of the inventive concept as expressed herein. For example, although capillary tube 24, has in the preferred embodiments, been described as the means for drawing liquid Freon from tanks 21 and 23 to rotary valve 25 (FIGS. 1 and 2), pumps may alternatively be disposed respectively in tank outlet lines 26 and 56 for pumping liquid Freon to the rotary valve. Operation of the pumping means is synchronized to indexing of rotary valve 25 whereby the pump in line 26 is operated only when the rotary valve is in the clockwise position, and the pump in line 56 is operated only when the rotary valve is in the counterclockwise position.

What is claimed is:

1. A power system comprising first and second tank means for liquid refrigerant; means for heating the refrigerant to produce super-heated vapor; means for transferring refrigerant selectively from said first and second tank means to said heating means; engine means for converting energy of the super-heated vapor into motive power; means for condensing the super-heated vapor; means associated with said first and second tank means for detecting a low level of refrigerant contained herein; and valve means for forming (1) a first flow of refrigerant along a first closed fluid flow path from said first tank means to said second tank means and including respectively said heating means, said engine means, and said condensing means, and (2) a second flow of refrigerant along a second closed fluid flow path from said second tank means to said first tank means and including respectively said heating means, said engine means and said condensing means; said valve means being controlled to provide alternatively (1) or (2) in response to an output of said refrigerant detecting means.

2. The system of claim 1, wherein said refrigerant transferring means comprises capillary means connected to a high pressure outlet of said engine means for drawing refrigerant from said first and second tank means to said heater means.

3. The system of claim 1, wherein said refrigerant detecting means includes temperature responsive means responsive to the temperature of the refrigerant in said first and second tank means, said temperature responsive means detecting boiling of said refrigerant.

4. The system of claim 3, wherein said temperature responsive means includes a thermostatic switch in thermal contact with a lower end portion of each of said tank means.

5. The system of claim 1, wherein said valve means includes motor means for indexing said valve means to provide alternatively (1) or (2) in response to said refrigerant detecting means.

6. The system of claim 5, wherein said motor means includes electrical solenoid means connected to said refrigerant detecting means and said valve means, said solenoid means being actuated in response to an output of said detecting means.

7. The system of claim 6, wherein said valve means includes a multiport rotary valve.

8. The system of claim 7, wherein said solenoid means includes first and second solenoids located on opposite sides of said valve, one of said solenoids being actuated to rotate said rotary valve to provide (1) and the other of said solenoids being actuated to provide (2).

9. The system of claim 8, wherein each of said solenoids is pivotally mounted on a base member to permit pivoting of said solenoids during rotation of said rotary valve.

10. The system of claim 1, including thottle means bypassing said engine means for controlling an amount of the super-heated vapor supplied to drive said engine means.

11. The system of claim 7, wherein said multiport rotary valve includes a valve body containing a plurality of ports, a rotary disc rotatably mounted in said body and containing U-channel means, said U-channel means joining together preselected pairs of said ports in accordance with the rotational position of said disc.

12. The system of claim 8, wherein said first and second solenoids control a common armature, and said valve is coupled to said common armature.

13. The system of claim 1, wherein said engine means includes a casing having an inlet and an outlet; rotor means rotatably mounted within said casing, a rim of said rotor means being exposed to said inlet; and means for supplying said super-heated vapor to said inlet; said rotor means including means responsive to said super-heated vapor supplied to said inlet for sustaining rotation of said rotor means.

14. The system of claim 13, wherein said sustaining means includes a series of indentations formed along the rim of said rotor means, said indentations being impinged by said super-heated vapor supplied to said inlet.

15. The system of claim 14, wherein said indentations are half-moon ground and inclined toward said inlet with respect to radii of said rotor means.

16. A power system comprising first and second tank means for liquid refrigerant; means for heating the refrigerant to produce super-heated vapor; means for transferring the refrigerant selectively from said first and second tank means to said heating means; engine means for converting the energy of the super-heated vapor to motive power; means for condensing super-heated vapor; means for detecting an amount of refrigerant in said first and second tank means; and valve means for directing the liquid refrigerant between said first and second tank means, said refrigerant passing respectively through said heating means for forming the super-heated vapor, said engine means, and said condenser means for converting the super-heated vapor to liquid refrigerant; said valve means alternatively causing said first and second tank means to function as (1) a source and sink respectively, or (2) a sink and source, respectively, said valve means being operated in response to an output of said refrigerant detecting means.

17. The system of claim 16, wherein said transferring means includes capillary means connected to a high pressure outlet of said engine means for drawing refrigerant from said first and second tank means to said heater means.

18. The system of claim 16, wherein said refrigerant detecting means includes a dual temperature thermostatic switch means containing a pair of thermostatic bulbs responsive respectively to the temperature of the refrigerant in said first and second tank means.

19. The system of claim 18, including motor means responsive to said thermostatic switch for controlling said valve means to cause said first and second tank means to function selectively as (1) or (2).

20. The system of claim 19, wherein said valve means icludes a multiport valve, and said motor means includes first and second solenoids, said first solenoid indexing said valve to cause said first and second tank means to function as (1) and said second solenoid indexing said valve to cause said first and second tank means to function as (2).

21. The system of claim 20, wherein said multiport valve is a rotary valve, and said first and second solenoids are located respectively on opposite sides of said rotary valve and coupled to a stem of said rotary valve.

22. The system of claim 20, wherein said first and second solenoids control a common armature, and said valve is coupled to said common armature.

23. The system of claim 21, wherein said solenoids are pivotally mounted to a base member to permit pivoting of said solenoids during indexing of said rotary valve.

24. The system of claim 6, wherein said engine means includes a casing having an inlet and an outlet; rotor means rotatably mounted within said casing, a rim of said rotor means being exposed to said inlet; and means for supplying said super-heated vapor to said inlet, said rotor means responsive to said super-heated vapor supplied to said inlet for sustaining rotation of said rotor means.

25. The system of claim 24, wherein said sustaining means includes a series of indentations formed along the rim of said rotor means, said indentations being impinged by said super-heated vapor supplied to said inlet.

26. The system of claim 25, wherein said indentations are half-moon ground and inclined toward said inlet with respect to radii of said rotor means.

27. Method of continuously powering an engine means from liquid refrigerant comprising the steps of (1) heating the liquid refrigerant stored in a first tank functioning as a source to form a super-heated vapor; (2) supplying the super-heated vapor to said engine means, said engine means converting energy contained in the super-heated vapor to motive power; (3) condensing the super-heated vapor exhausted by said engine means to re-form liquid refrigerant; (4) directing the re-formed liquid refrigerant to a second tank functioning as a sink; (5) detecting a low level of refrigerant contained in said first tank; and, in response to said step of detecting, repeating steps (1)–(4) with said second tank functioning as the source and said first tank functioning as the sink.

28. The method of claim 27, wherein the refrigerant is Freon.

29. The method of claim 27, including the step of causing a controlled portion of the refrigerant to bypass said engine means for throttling.

30. The method of claim 27, wherein said step of detecting includes the step of detecting boiling of the refrigerant in the first tank.

31. In combination: first and second tank means for liquid refrigerant; means for heating the refrigerant to produce super-heated vapor; means for transferring the refrigerant selectively from said first and second tank means to said heating means; means for condensing super-heated vapor; means for detecting an amount of refrigerant in said first and second tank means; and valve means for directing the liquid refrigerant between said first and second tank means, said refrigerant passing respectively through said heating means for forming the super-heated vapor and said condenser means for converting the super-heated vapor to liquid refrigerant; said valve means alternatively causing said first and second tank means to function as (1) a source and sink, respectively, or (2) a sink and source, respectively, said valve means being operated in response to an output of said refrigerant detecting means.

32. The combination of claim 31, wherein said refrigerant detecting means includes means responsive respectively to the temperature of the refrigerant in said first and second tank means.

* * * * *